US007188455B2

(12) United States Patent
Brugeaud et al.

(10) Patent No.: US 7,188,455 B2
(45) Date of Patent: Mar. 13, 2007

(54) ROOFING ELEMENT

(75) Inventors: Yves Brugeaud, Brive (FR); Ramez Kamel, Paris (FR)

(73) Assignee: Conseil Services Investissements, Brive (FR)

( * ) Notice: Subject to any disclaimer, the term of this patent is extended or adjusted under 35 U.S.C. 154(b) by 350 days.

(21) Appl. No.: 10/440,127

(22) Filed: May 19, 2003

(65) Prior Publication Data

US 2005/0050821 A1 Mar. 10, 2005

(51) Int. Cl.
*E04C 1/00* (2006.01)
*E04C 2/288* (2006.01)

(52) U.S. Cl. ..... 52/576; 52/309.12; 52/439; 52/404.3; 52/783.1; 52/793.11

(58) Field of Classification Search ..... 52/309.16, 52/309.17, 325, 334, 382, 405.1, 439, 404.3, 52/576, 794.1, 793.11, 783.1, 309.12, 404.1, 52/577, 404.5, 580; 428/187–188, 34.9; 264/256

See application file for complete search history.

(56) References Cited

U.S. PATENT DOCUMENTS

| | | | | | |
|---|---|---|---|---|---|
| 4,056,910 | A * | 11/1977 | Hiatt et al. | ..... | 52/600 |
| 4,141,946 | A * | 2/1979 | Rauenhorst | ..... | 264/69 |
| 4,232,494 | A * | 11/1980 | Bauch et al. | ..... | 52/309.12 |
| 4,329,827 | A * | 5/1982 | Thorn | ..... | 52/790.1 |
| 4,655,016 | A * | 4/1987 | Jacob | ..... | 52/169.1 |
| 5,030,502 | A * | 7/1991 | Teare | ..... | 428/193 |
| 5,095,674 | A * | 3/1992 | Huettemann | ..... | 52/405.3 |
| 6,460,213 | B1 * | 10/2002 | Flint et al. | ..... | 52/309.17 |
| 6,869,669 | B2 * | 3/2005 | Jensen et al. | ..... | 428/294.7 |

FOREIGN PATENT DOCUMENTS

| | | |
|---|---|---|
| EP | 128613 | * 12/1984 |
| FR | 2.166.574 | 8/1973 |
| WO | WO 80/00232 | 2/1980 |
| WO | WO 99/51829 | 10/1999 |

* cited by examiner

*Primary Examiner*—Winnie Yip
(74) *Attorney, Agent, or Firm*—Young & Thompson

(57) ABSTRACT

A roofing element comprises a structural box of concrete and an insulating layer extending inside the structural box.

13 Claims, 4 Drawing Sheets

ROOFING ELEMENT

The present invention relates to a wall element, and more particularly to a roofing element suitable for use in particular in the roofs of non-residential buildings such as industrial buildings or institutional buildings.

BACKGROUND OF THE INVENTION

The roofs of such buildings generally comprise framing made of metal, concrete, or wood, having roofing elements fixed thereto.

Roofing elements in the form of ribbed metal plates fixed on purlins extending between the rafters of the framing are known. Such metal plates are covered in insulation and asphalt sealing layers. Such roofing elements require framing that is complex, using multiple components that are assembled together on site. Such roofs are thus relatively time-consuming and expensive to build and they also turn out to be dangerous, given the number of operations which need to be performed at height. In addition, the asphalt layers require maintenance operations relatively frequently and they have a lifetime that does not exceed about 15 years. Furthermore, given their composition, the asphalt layers tend to facilitate the propagation of fire.

In order to mitigate that drawback, roofs of that type are generally covered in a layer of gravel chippings that is several centimeters thick, thereby limiting the propagation of flames cowards the top of the roof. However that makes the roof more complicated to build and significantly heavier.

Roofing elements in the form of corrugated metal sheets sandwiching an insulating layer are also used. Such roofing elements can be made to be relatively long so they can be mounted directly between the rafters of the framework without having recourse to purlins. Nevertheless, those roofing elements are generally quite thick, about 2 meters (m) thick for the longest spans. The use of such roofing elements thus leads either to a considerable increase in the outside height of the building, or else to a considerable decrease in the inside height thereof.

OBJECTS AND SUMMARY OF THE INVENTION

It would therefore be advantageous to have a roofing element that remedies the drawbacks of the prior art.

For this purpose, the invention provides a roofing element comprising a structural box of concrete having at least one longitudinally prestressed portion and an insulating layer extending inside the structural box.

With this structure, the roofing element can be used for large spans, of the order of 12 m to 20 m, while still being of a thickness that is relatively small, of the order of 40 centimeters (cm). The weight of such elements is also relatively small. Roofing elements made in this way also have a lifetime that is long, being equivalent to that of the concrete structure of the building on which they are fitted. Furthermore, the roofing element is easily machined so as to enable it to be fitted to a support structure such as framing and/or adjacent roofing elements.

In a particular embodiment, the structural box comprises two plates extending over opposite faces of the insulating layer and united by side walls, the plates having inside surfaces that are ribbed, and/or the structural box having internal partitions.

This structure is particularly strong.

Advantageously, the concrete of the structural box comprises a cement matrix containing reinforcing fillers such as metal fibers, synthetic fibers, or organic fibers.

Preferably, the insulating layer is made of lightweight concrete advantageously comprising a matrix of cement containing beads of polystyrene.

It is possible to obtain an insulating layer presenting density of about 200 kilograms per cubic meter (kg/m$^3$) to 400 kg/m$^3$, with 28-day compression strength of about 1 megapascal (MPa) to 2 MPa. The insulating layer is easy to machine, thus making it easier to manufacture the wall elements, particularly when the structural box has internal ribs and the insulating layer is used as an insert in the shuttering into which the concrete forming the box is cast. In addition, this type of material is substantially incombustible or not flammable.

BRIEF DESCRIPTION OF THE DRAWINGS

Other characteristics and advantages of the invention appear on reading the following description of particular, non-limiting embodiments of the invention.

Reference is made to the accompanying drawings, in which.

MORE DETAILED DESCRIPTION

Figure 1:
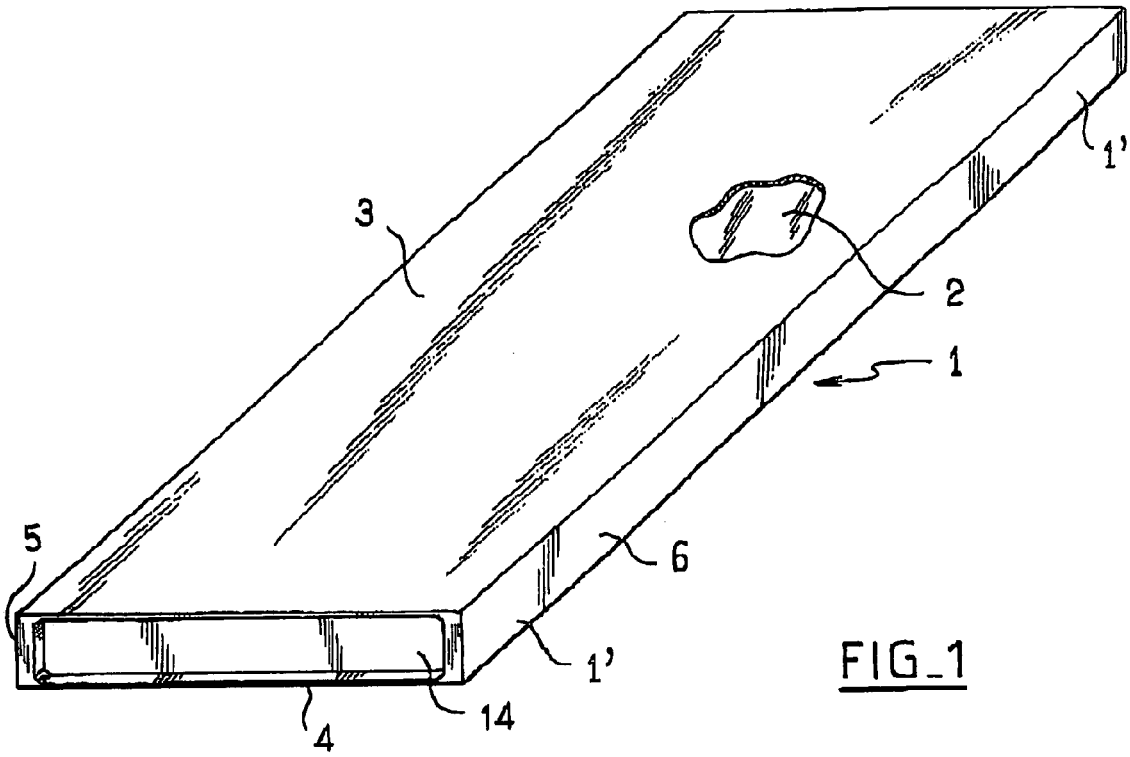
FIG. 1 is a perspective view of a roofing element constituting a first embodiment of the invention.

The wall element described is designed to be fixed to framing so as to form a roofing element. This wall element can also be used in association with a support structure to form cladding.

With reference to the figures, the roofing element of the invention comprises a structural box given overall reference 1 and an insulating layer 2 extending inside the structural box 1.

The structural box 1 comprises two plates 3 and 4 extending over opposite faces of an insulating layer 2 and united by side walls 5 and 6.

The ends 1' of the box are closed by internal transverse partitions 14 which isolate the inside of the structural box 1 together with the insulating layer 2 from the outside, and in particular from fire and from water. The internal transverse partitions 14 also reinforce the structural box 1 structurally.

The structural box 1 is made of a material comprising a cement matrix containing metal fibers, synthetic fibers, or organic fibers dispersed therein. This material is made from aggregates of small grain size, preferably less than 0.3 mm, and water. In conventional manner, it is possible to include additives in order to obtain a determined level of plasticity with a minimum amount of mixing water. Advantageously, the composition of the material is determined so that it provides good resistance to cyclical freezing and unfreezing (no deterioration in its properties after 300 cycles), a low level of capillary porosity, advantageously less than 10 μm (or less than 1%), and a low level of total porosity, advantageously lying in the range 2% to 6%, with shrinkage after curing of less than $10^{-5}$. These characteristics in combination give the material a lifetime that is longer than that of conventional concretes and they give it intrinsic impermeability, in the absence of cracking.

The concrete constituting the structural box, and more particularly constituting the plate that is to be on the inside of the building, may include plastics fibers so that in the event of an increase in temperature, melting of the plastics fibers makes it possible to release at some of the internal stresses.

The outside surfaces of the plates 3 and 4, and more particularly the surface that is to face towards the inside of the building may be covered completely or in part in a layer of intumescent paint.

The inside surfaces of the plates 3 and 4, and more particularly the inside surface of the plate that is on the inside of the building is preferably covered in full or in part in a layer of plaster, serving in particular in the event of a fire to slow down the diffusion of heat into the inside of the box.

The insulating layer 2 is advantageously made of a lightweight insulating concrete which is advantageously constituted by a cement matrix containing polystyrene beads dispersed therein. While making this concrete, it is possible to add the following additives to the cement, the polystyrene beads, and the mixing water: hydraulic lime; an additive of the animal protein type; and/or a chalk or limestone filler; in particular.

In a variant, when the fire behavior of the insulating layer is not a determining characteristic, the insulating layer 2 may be made of blocks of polystyrene foam or of polyurethane foam or indeed of any other low density insulating material.

In the following description of other embodiments, elements that are identical or analogous to those described above are given identical numerical references.

In the description below, it is assumed that the plate referenced 4 is the plate that is to lie on the inside of the building.

In the embodiment of FIG. 1, corresponding to the simplest embodiment of the roofing element of the invention, the plates 3 and 4 have inside surfaces that are smooth.

Figure 2:
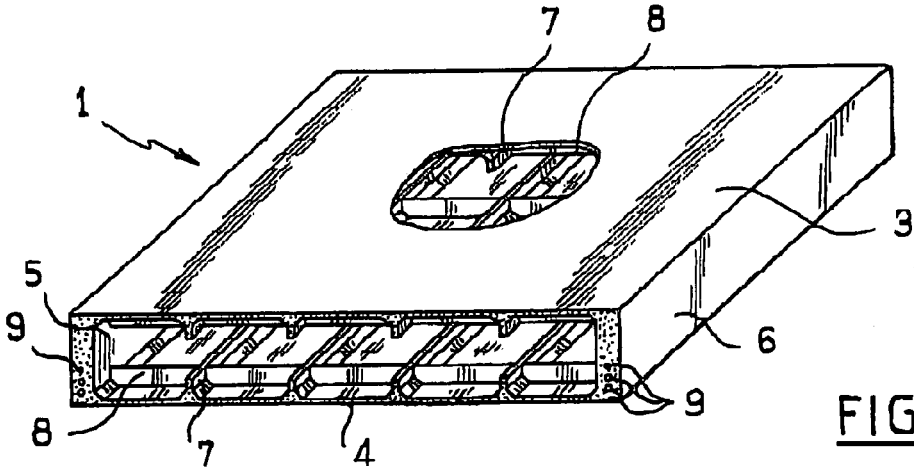
FIG. 2 is a partially cutaway perspective view and cross-section view of a structural box forming part of a roofing element constituting a second embodiment of the invention.

In the second embodiment as shown in FIG. 2, longitudinal and transverse ribs 7 and 8 extend over the inside surfaces of the plates 3 and 4. These ribs serve to stiffen the structural box 1.

The structural box 1 has a prestressed longitudinal portion which in this case extends in those portions of the side walls 5 and 6 that are adjacent to the plate 4, i.e. in the portions of the side walls that usually extend beneath the zero stress line. Prestress is provided by means of adhesion-bonded cables 9 embedded in the concrete to exert a compression force on this portion of each side wall 5, 6.

The insulating layer 2 (not shown here) has grooves for receiving the longitudinal and transverse ribs 7 and 8.

Figure 3:
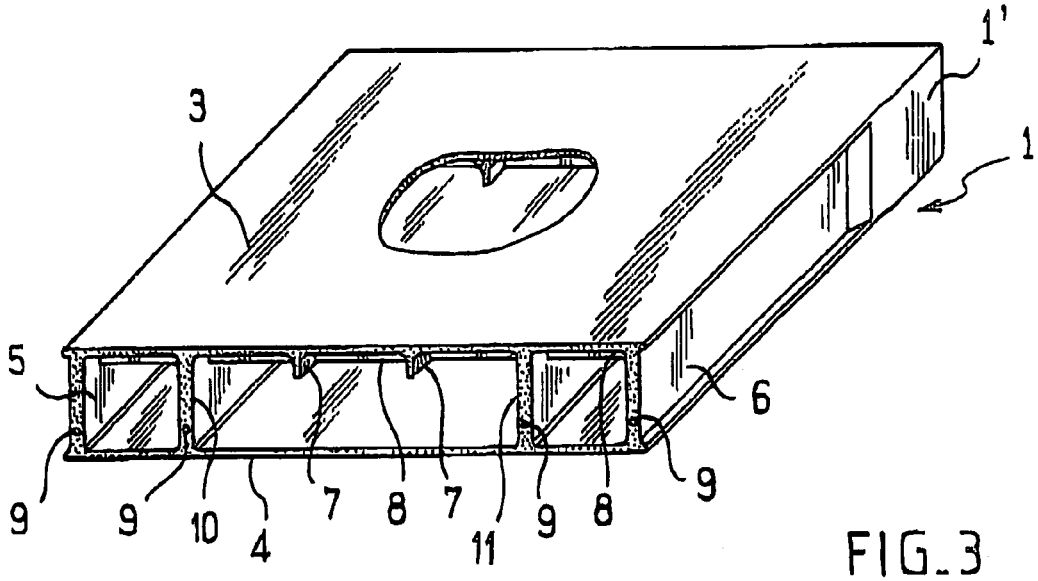
FIG. 3 is a view analogous to FIG. 2 showing a structural box of a roofing element constituting a third embodiment of the invention.
Figure 4:
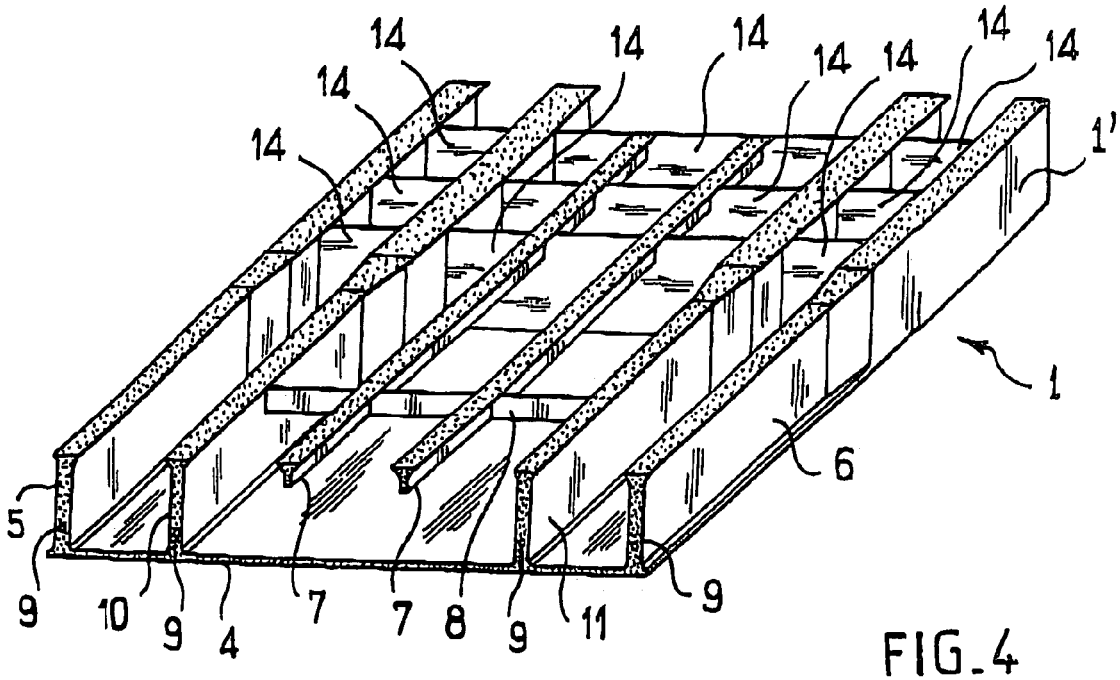
FIGS. 4 and 5 are partially cutaway fragmentary perspective views of the structural box of said FIG. 3 embodiment.
Figure 5:
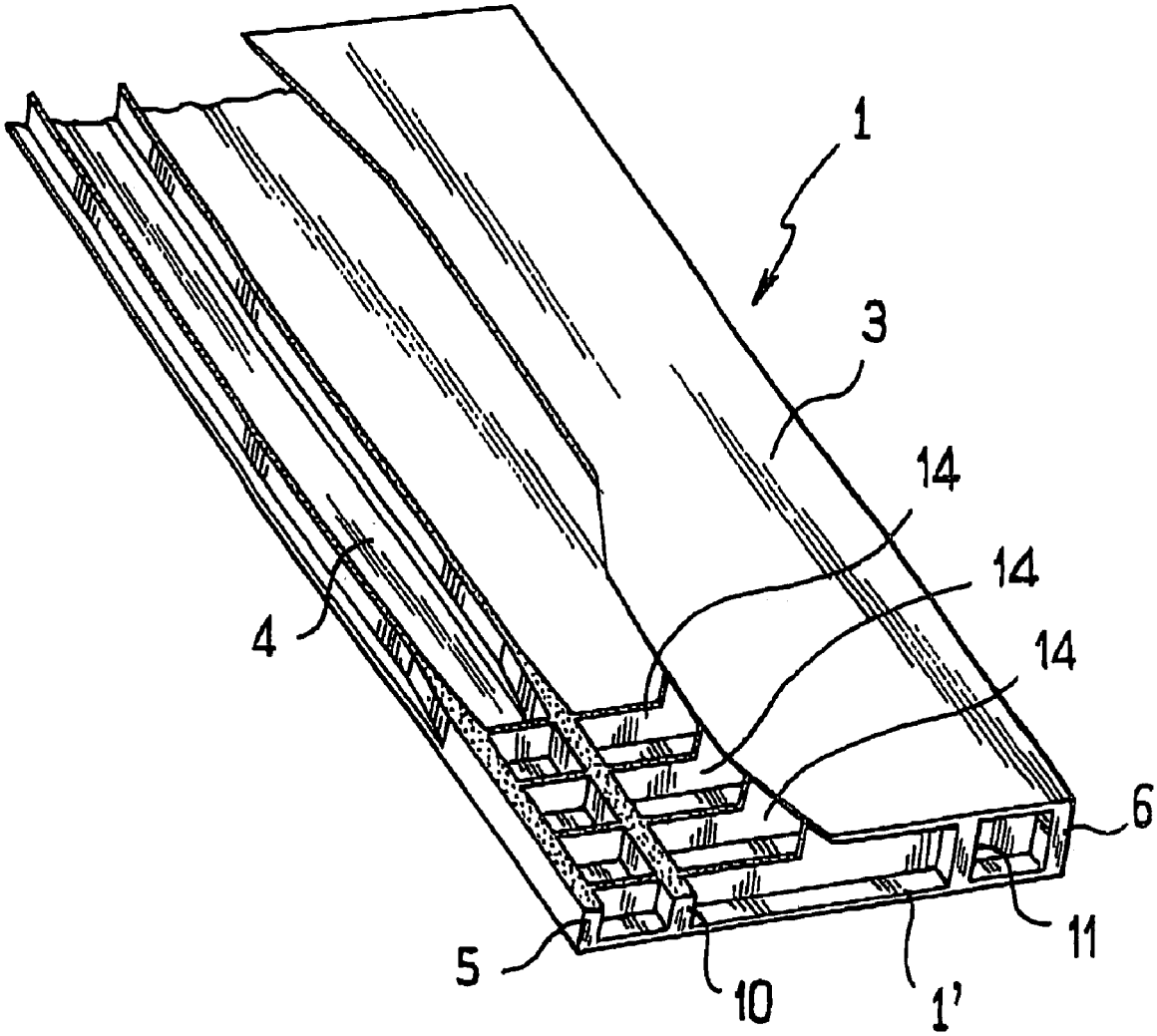

In the third embodiment shown in FIGS. 3 and 4 (in FIG. 4 the plate 3 is omitted), and in FIG. 5, longitudinal ribs 7 and transverse ribs 8 extend over the inside surface of the plate 3 and the inside surface of the plate 4 is smooth.

In addition, two internal longitudinal partitions 10 and 11 extend inside the structural box 1 between the plates 3 and 4 parallel to the side walls 5 and 6.

In this case, prestress elements 9 extend longitudinally in those portions of the side walls 5 and 6 and of the internal partitions 10 and 11 that are adjacent to the plate 4.

It should be observed that the ends 1' of the box 1 contain a plurality of internal transverse walls 14 that are parallel to one another for closing the ends 1'. When cutting a roofing element to shorten it, this makes it possible to ensure that at least one transverse partition 14 remains after the cutting operation so as to protect and isolate the inside of the structural box 1 together with the insulating layer 2 from the outside, and also, for example, from flames in the event of a fire, or from water, The internal transverse walls also contribute to reinforcing the strength of the structural box 1.

Figure 6:
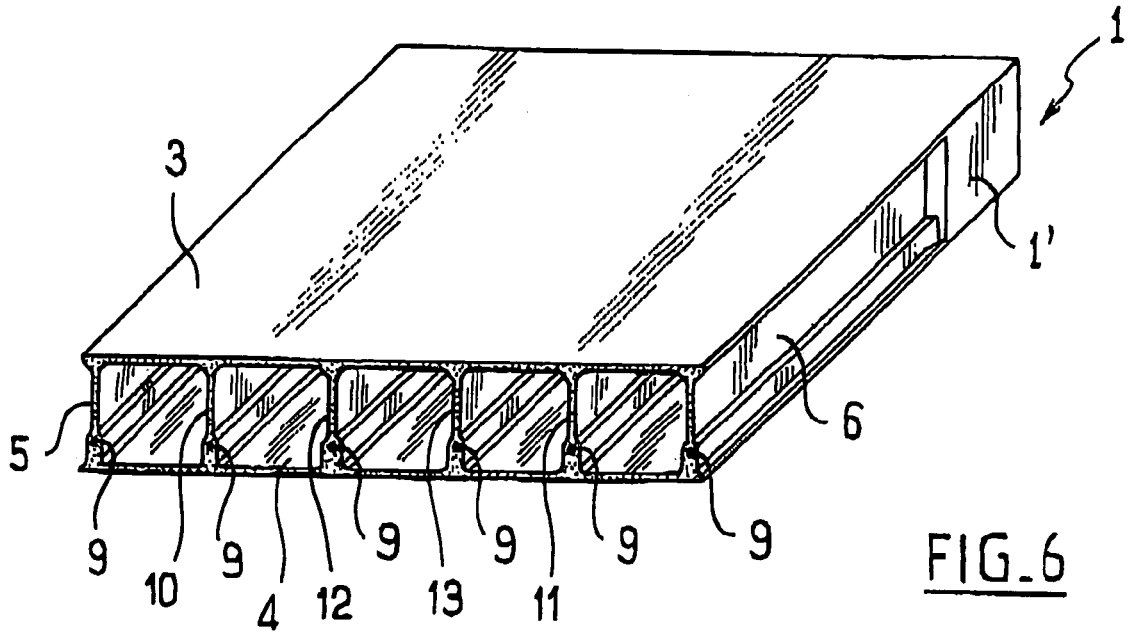
FIG. 6 is a view analogous to FIG. 2 showing a fourth embodiment of a roofing element.
Figure 7:
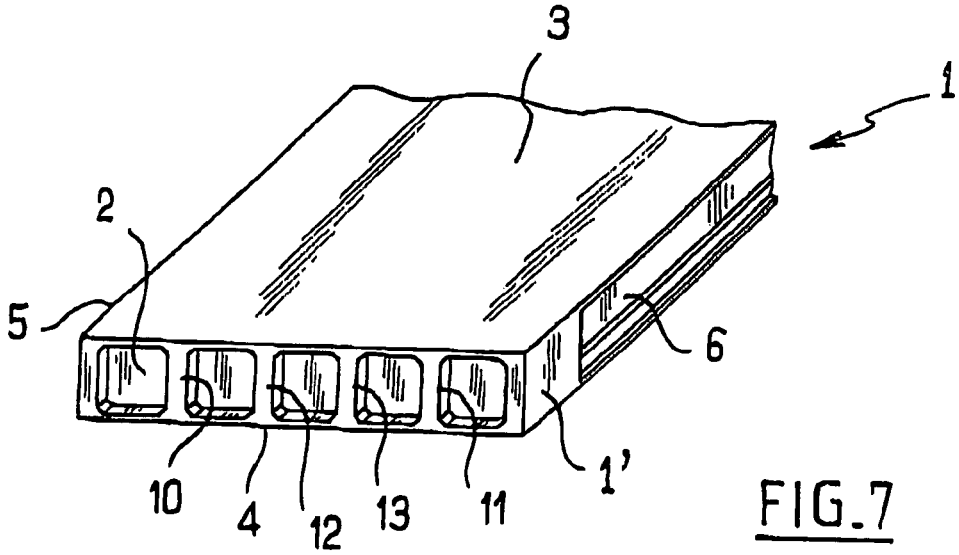
FIG. 7 is a fragmentary perspective view of one end of the FIG. 6 roofing element.

In the fourth embodiment shown in FIGS. 6 and 7, the structural box is internally partitioned by partitions 10, 11, 12, and 13 extending longitudinally between the plates 3 and 4 and parallel to the side walls 5 and 6.

Prestressing elements 9 extend in those portions of the side walls 5 and 6 and of the internal partitions 10, 11, 12, and 13 that are adjacent to the plate 4.

It should be observed in particular in FIGS. 4, 5, and 6, that the side walls 5 and 6 and the internal partitions 10, 11, 12, and 13 are thicker in the vicinity of each end 1' of the structural box 1. This makes it possible to cut the element to length or to drill it for the purposes of fixing the wall elements to one another without weakening the structural box 1. This also serves to take up forces better.

In general, the wall element is easily machined (e.g. cut) so as to pass ducts or trunking, in particular in a vertical direction, or so as to enable them to be fitted to other elements.

The wall element of the invention is made initially by making the insulating layer 2 by casting concrete in shuttering of dimensions that correspond to the dimensions of the inside space of the structural box 1.

When the structural box 1 is to have internal ribs, then corresponding ribs are machined in the insulating layer 2 after it has set. To make wall elements having internal partitions, chasing is machined in the insulating layer 2.

Concrete is then cast into the bottom of shuttering having inside dimensions that correspond to the outside dimensions of the structural box 1 in order to form the plate 4.

Immediately after the concrete has been cast, the insulating layer 2 is deposited on the plate 4 and then the assembly is covered in concrete to form the side walls 5 and 6 and the plate 3. When the insulating layer 2 has grooves, it is necessary for the concrete to penetrate into the grooves so that they constitute a molding cavity for making the ribs. The same applies when the insulating layer has chasing.

The lightweight insulating concrete used for the insulating layer is considered as being incombustible or non-flammable and its thermal insulation properties slow down the spread of heat, thereby reducing the rise in temperature of the top place and also of the side walls and the internal partitions. With wall elements of this type, it is possible to obtain fire stability of about 60 minutes, at least. The fire behavior of such a roofing element is thus particularly advantageous.

This embodiment makes it possible to provide good bonding between the concrete forming the structural box and the concrete forming the insulating layer. In the event of the wall element cracking, this bonding tends to hold the cracked portions together with the remainder of the wall element.

Furthermore, with a ribbed or partitioned structure, damage to the plate 4 gives rise to substantially no shape instability in the remainder of the wall element.

Naturally, the invention is not limited to the embodiments described, and variants can be applied thereto without going beyond the ambit of the invention as defined by the claims.

In particular, other methods of manufacturing the wall element can be envisaged.

Furthermore, the configuration of the internal ribs and/or of the internal partitions of the structural box, and the arrangement and/or the number of prestress elements can be modified, in particular as a function of the forces that the wall element is to withstand and as a function of the direction in which they are applied, as a function of the mechanical properties of the insulating layer, of the mechanical properties of the concrete used.

What is claimed is:

1. A roofing element, comprising:

a structural box of concrete having an insulating layer extending inside the structural box, the structural box comprising, beneath a zero stress line of the structural box, at least one longitudinal portion in which is embedded a longitudinally prestressed element to exert a compression force on the at least one longitudinal portion, wherein the structural box comprises two plates extending over opposite faces of the insulating layer and united by side walls, wherein the structural box is internally partitioned by internal partitions, and wherein the side walls and the internal partitions are thicker close to ends of the structural box.

2. A roofing element, comprising a structural box of concrete having an insulating layer extending inside the structural box, the structural box comprising, beneath a zero stress line of the structural box, at least one longitudinal portion in which is embedded a longitudinally prestressed element to exert a compression force on the at least one longitudinal portion, the concrete having a level of capillary porosity less than 10 μm or 1% and a level of total porosity lying in the range of 2% to 6%, with shrinkage after curing of less than $10^{-5}$.

3. The roofing element according to claim 2, wherein the structural box comprises two plates extending over opposite faces of the insulating layer and united by side walls.

4. The roofing element according to claim 3, wherein one of the plates has an inside surface that is ribbed.

5. The roofing element according to claim 3, wherein the structural box is internally partitioned by internal partitions.

6. The roofing element according to claim 2, wherein the concrete of the structural box comprises a cement matrix containing reinforcing fillers.

7. The roofing element according to claim 6, wherein the reinforcing fillers are metal fibers.

8. The roofing element according to claim 6, wherein the reinforcing fillers are synthetic fibers.

9. The roofing element according to claim 6, wherein the reinforcing fillers are organic fibers.

10. The roofing element according to claim 2, wherein the insulating layer is made of lightweight concrete.

11. The roofing element according to claim 10, wherein the concrete of the insulating layer comprises a cement matrix containing polystyrene beads.

12. The roofing element according to claim 2, wherein the insulating layer is made of at least one of polystyrene and polyurethane.

13. The roofing element according to claim 2, wherein the box has ends each closed by at least one internal transverse partition.

* * * * *